United States Patent [19]

Boisbluche

[11] Patent Number: 4,530,191

[45] Date of Patent: Jul. 23, 1985

[54] ISOTHERMIC WALL WITH THREE DIMENSIONAL FRAMEWORK AND PROCESS OF CONSTRUCTING SAME

[75] Inventor: Arsène G. Boisbluche, Juvigny sous Andaine, France

[73] Assignee: Sambuchi-Boisbluche et Cie, France

[21] Appl. No.: 344,756

[22] Filed: Feb. 1, 1982

[30] Foreign Application Priority Data

Feb. 9, 1981 [FR] France ..... 81 02514

[51] Int. Cl.[3] ..... E04C 2/26

[52] U.S. Cl. ..... 52/309.7; 52/309.11; 52/407; 52/650; 52/694

[58] Field of Search ..... 52/383, 646, 648, 650, 52/660, 664, 309.12, 309.11, 407, 309.7, 405, 577

[56] References Cited

U.S. PATENT DOCUMENTS

| | | | |
|---|---|---|---|
| 1,799,750 | 4/1931 | Hummert | 52/660 X |
| 1,864,773 | 6/1932 | Stanford | 52/650 X |
| 3,305,991 | 2/1967 | Weismann | 52/309.7 |
| 3,672,022 | 6/1972 | York | 52/664 X |
| 3,879,908 | 4/1975 | Weismann | 52/309.12 |
| 4,125,981 | 11/1978 | MacLeod | 52/309.12 |
| 4,253,288 | 3/1981 | Chun | 52/309.12 |
| 4,336,676 | 6/1982 | Artzer | 52/309.7 |
| 4,454,702 | 6/1984 | Bonilla-Lugo et al. | 52/309.12 |

FOREIGN PATENT DOCUMENTS

| | | | |
|---|---|---|---|
| 77206 | 7/1919 | Austria | 52/650 |
| 2703068 | 7/1978 | Fed. Rep. of Germany | 52/650 |
| 2307928 | 11/1976 | France | 52/309.12 |
| 2422778 | 11/1979 | France | 52/405 |
| 2023215 | 12/1979 | United Kingdom | 52/309.12 |

*Primary Examiner*—John E. Murtagh
*Assistant Examiner*—Kathryn Ford
*Attorney, Agent, or Firm*—Schiller & Pandiscio

[57] ABSTRACT

The present invention relates to a three dimensional metal framework, designed for forming isothermic walls of buildings, which comprise an inner air cavity in form of a blade along one of its faces.

This framework (9) comprises rectilinear and parallel rods (14) which are welded, in at least two parallel rows (14*a*, 14*b*), on sinusoidal wires (15) which extend in planes perpendicular to the rectilinear rods and whose tops (15*a*, 15*b*) are situated in two planes parallel with the two rows of rectilinear rods, the first row (14*a*) of rectilinear rods being furthermore slightly spaced apart from a first one of the planes containing the tops (15*a*) of the sinusoidal wires.

The invention also relates to a constructional element built from this framework and comprising a bearing wall (4) and a heat insulating layer (5) both disposed between the two rows (14*a*, 14*b*) of the rectilinear rods of the framework (9) as well as two finishing coverings (2*b*, 3*b*) formed on the tops (15*a*, 15*b*) of the sinusoidal wires of the latter. An air cavity in form of a blade is therefore formed along one of the finishing coverings.

The invention also relates to a process for constructing a constructional element of this type which constitutes an external wall of a house.

15 Claims, 7 Drawing Figures

ISOTHERMIC WALL WITH THREE DIMENSIONAL FRAMEWORK AND PROCESS OF CONSTRUCTING SAME

The present invention relates to a three dimensional metal framework for use in forming isothermic walls for buildings. It also relates to a constructional element, such as an isothermic wall, formed by means of this framework as well as a process of constructing such a wall.

To comply with the increasing demand from clients and to satisfy official regulations at present in force in the construction industry, some building contractors are devoting more and more effort to improving the inside comfort of habitable premises and, more especially, to improving the thermal and acoustic insulation of individual houses and blocks of flats, especially the insulation provided in exterior walls of such structures.

Theoretical research carried out in this industry has shown that by providing an air gap or cavity the form of a blade in combination with a heat insulating layer in the outer walls of a dwelling there is provided suitable thermal and acoustic damping between the outside and the inside thereof. Up to present, however, it has not been possible to provide practical means for forming this air cavity in a simple and economical way.

Furthermore, the thermal stabilisation of the walls, i.e. their protection against thermal shocks resulting for example from a considerable temperature variation between summer and winter, has never been able to be satisfactorily mastered.

Finally, it is difficult at the present time to construct isothermic walls which are sufficiently strong to form the bearing structure of a building and fairly light so as not to cause too great a damage, both from the human and the material point of view, should they collapse following an earthquake for example.

Starting from these established facts, the present applicant has designed a three dimensional metal framework which allows strong and light walls for buildings to be constructed, in a simple and economical way. Each wall has an inner air cavity along one of its faces and possesses good thermal and acoustic insulating power, which may be even improved with respect to that of walls whose construction is at present known.

According to the invention, this framework is characterized in that it comprises a number of rectilinear and parallel rods welded to several sinuous substantially sinusoidal and superimposable wires which extend in parallel planes perpendicular to the rectilinear rods. The edge tips of the wires, where each essentially changes direction, lie in substantially two parallel planes. The rectilinear rods are grouped together as a whole or in part in first and second rows parallel to said two planes of the wired edge tips, as to define therebetween a space of a certain width the first row of rectilinear rods being furthermore spaced slightly apart from a first one of the planes containing the tops of the sinusoidal wires.

From this framework there may be constructed, still in accordance with the invention, a constructional element, such as a wall, a ceiling or a dividing wall, of the type comprising a central part disposed between two finishing coverings. The central part includes the three-dimensional framework, a bearing wall made for example, of cavernous concrete or similar material, on one of its faces, and thermal insulation. The central part is characterized in that the three dimensional framework is partially buried in the bearing wall. The central part occupies the space defined between the first and second rows of rectilinear rods, the edge tips of the sinusoidal wires situated in the first plane bear first finishing covering and those situated in the second plane bear the second finishing covering, so that at least one of these coverings defines with the central part an air cavity in form of a blade.

The prime advantage of the framework of the invention, in its application to the manufacture of a constructional element of this type, resides in the fact that it serves both for carrying the two finishing coverings, in maintaining one of these slightly spaced apart from the central part for defining the air cavity, in reinforcing or stiffening the concrete bearing wall and in supporting the thermal insulation when the latter is formed by solid insulating panels.

It will be further observed that this framework may be manufactured with small diameter rods and wires which makes it very light and perfectly appropriate for constructing buildings in zones subject to earthquakes. Its construction is moreover very simple and, because of its open structure, several of these frameworks may be readily transported piled flat on each other.

In the constructional element formed from this framework, the air cavity formed along one of the finishing coverings forms, as has been mentioned, a thermal and acoustic damper.

According to an important feature of this constructional element, one or more additional air cavities may be formed inside the thermal insulating layer and, when the latter is formed from solid insulating panels extending in planes parallel to the rows of rectilinear rods, the air cavities are formed preferably by positioning wooden battens parallel to the rectilinear rods of the framework between the insulating panels. This arrangement improves the insulating power of the constructional element. It will be moreover noticed that as a variation, additional rectilinear rods may be welded to the sinusoidal wires of the framework to play the role of the wooden battens in defining additional air cavities.

The constructional element of the invention may be formed from a framework such as defined above, in which the second row of rectilinear rods extends in the second of the planes containing the edge tips of the sinusoidal wires so that, on the rectilinear rods of this second row, there may be fixed a close mesh latticework serving as a support for the second finishing covering.

Similarly, this constructional element may be formed from a three dimensional framework in accordance with the invention, which comprises a third row, parallel to the first two, of rectilinear and parallel rods. This third row extends in said first plane containing the edge tips of the sinusoidal wires so that, on the rectilinear rods of this third row, there may be fixed a close mesh latticework serving as a support for the first finishing covering.

As a variation, however, when the first finishing covering is formed by wooden boarding, it is advantageous to clamp inside each group of superimposable tops of the sinusoidal wires, situated in said first plane, wooden battens on which this boarding may be nailed.

The constructional element of the invention is more particularly intended to form an outside wall of a dwelling and, in this case, it is characterized in that the rectilinear rods of the framework are oriented in a vertical direction and the first finishing covering forms the outer covering of the wall. The thermal insulation layer extends between the bearing wall and the air cavity is formed along this outer covering. In this wall, the air cavity is formed over the length of the outer finishing covering, in contact with the thermal insulating layer. The air cavity thus forms, between the inside and the outside of the dwelling, a thermal damper which ensures good heat conservation in winter and freshness in summer inside the dwelling and which also participates in the acoustic insulation thereof.

In this wall, the air cavity may be further open at its base and communicate at the top, for example through a ventilation aperture, with the outside air so as to form a ventilated air space which provides the additional advantage of thermally stabilizing the bearing wall, i.e. a protection of the bearing wall and of the outer covering against deteriorations, such as cracks which might result from considerable temperature variation between winter and summer.

The present invention also relates to an economical process of constructing such an isothermic wall characterized in that it comprises clamping thermal insulating panels between the sinusoidal wires of the framework and parallel to the rectilinear rods thereof so as to form the heat insulating layer, clipping the latticework to the rectilinear rods of the second row, fitting the inner finishing covering to this latticework, fitting the outer finishing layer to the corresponding edge tips of the sinusoidal wires, fixing the framework to a supporting wall while orientating its rectilinear rods in a vertical direction and disposing the third row of these rods on the outer side of the wall and pouring concrete between the inner covering and the insulating layer so as to form the bearing wall.

The prime advantage of this construction process resides in the fact that the bearing face of the wall may be constructed with lost shuttering by pouring concrete between the second finishing covering and the solid insulating panels.

One embodiment of the three dimensional framework of the invention and two embodiments of the constructional element produced from this framework will be described hereafter by way of non limiting examples with reference to the accompanying drawings in which.

Figure 1:
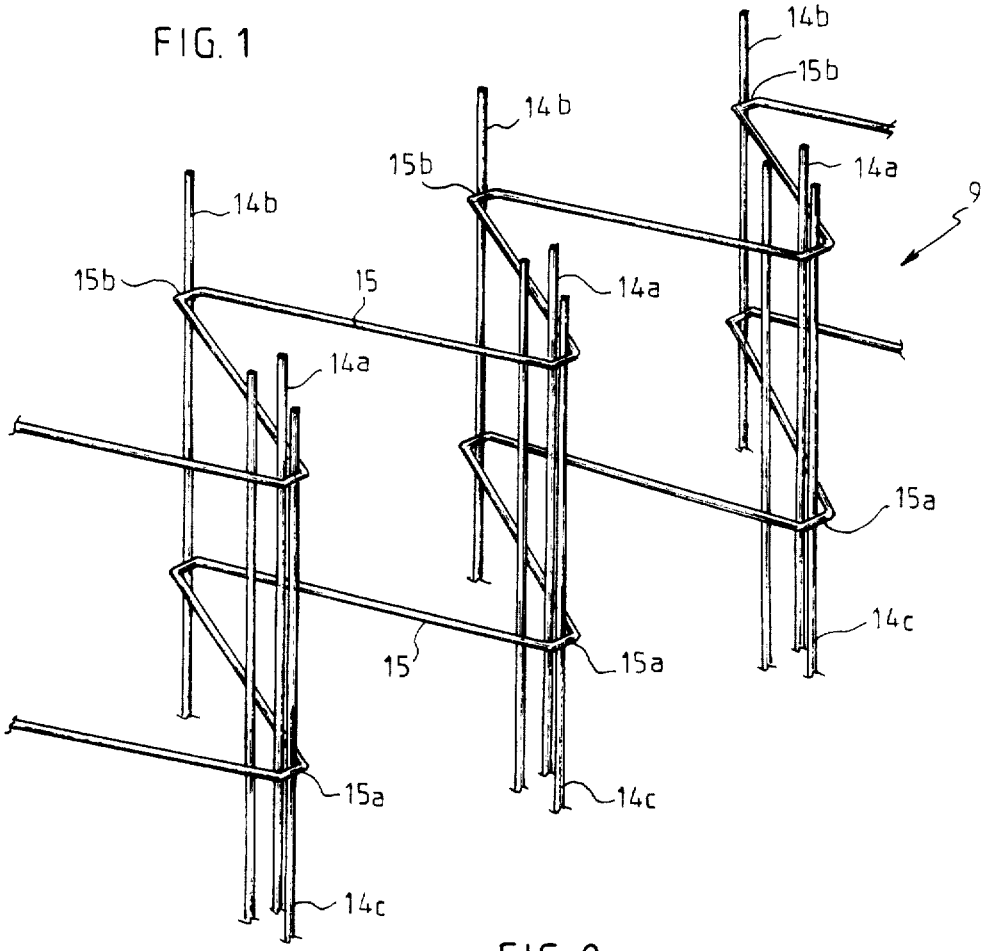
FIG. 1 is a perspective view of said embodiment of the framework.
Figure 2:
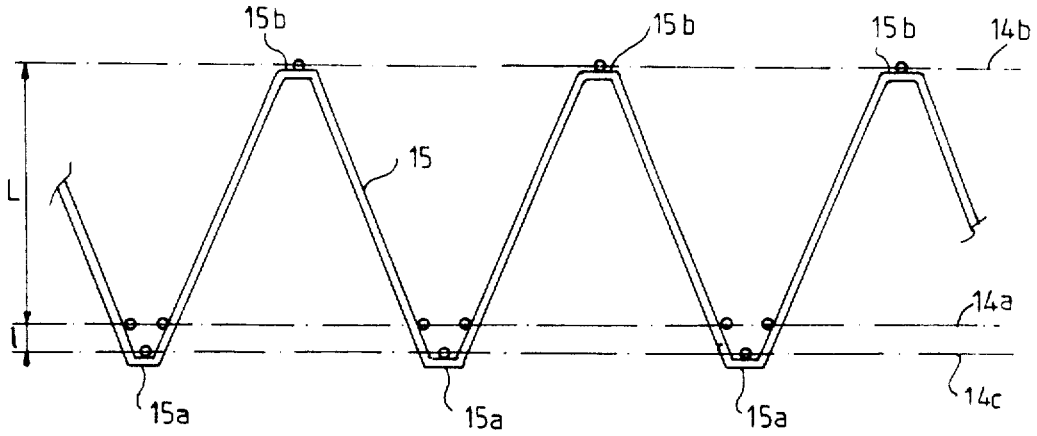
FIG. 2 is a top view of this framework.

As can be seen in FIGS. 1 and 2, the three dimensional metal framework 9 of the invention comprises a number of rectilinear rods 14*a*, 14*b*, 14*c* welded, parallel to each other, to several sinuous, substantially sinusoidal wires 15 or, more accurately, wires bent in a zig-zag shape, which are superimposable and extend in stepped planes perpendicular to the rectlinear rods.

The tops 15*a* and 15*b* of the sinusoidal wires 15 are situated so that some of the rectilinear rods 14*a* are grouped in a first row in one plane and rods 14*b* are grouped in a second row in a second plane, parallel to and spaced from the first plane by the width L. The first row of rods 14*a* are grouped in a third plane, parallel to and spaced from the second plane by the reduced width l.

As can be clearly seen in FIG. 2, the second row of rods 14*b* of rectilinear rods extends in the second plane containing the tips 15*b* and the remaining rectilinear rods, aligned in a third row 14*c* parallel to the first two 14*a* and 14*b*, are welded, parallel to each other, to the tips 15*b* situated in said first plane.

Rods 14 and wires 15 forming the framework 9 of the invention are preferably made from galvanized steel for corrosion resistance reasons and are of a relatively reduced diameter, in the order of 6 mm for the rectilinear rods 14 and 4 mm for the sinusoidal wires 15.

In order to produce the framework which has just been described, a substantially flat wide-mesh latticework is first formed by spot welding the rods 14 to wires of greater length which are disposed perpendicularly to rods 14. Then this latticework is bent into an accordion shape with traditional means so as to give the wires 15 their substantially sinusoidal configuration. Of course, during welding, the rods 14 are positioned on wires 15 so as to appear in the three abovementioned rows after the bending operation.

The framework thus produced is specially designed for constructing isothermic walls for buildings. In FIGS. 3 to 6, there is shown a section of a constructional element built up from such a framework, this constructional element being in the present case an external wall of a dwelling the interior of which is referenced by A and the exterior by B.

More precisely, this constructional element is formed of a central part 1, disposed between an inner finishing covering 2*a* or 2*b* and an outer finishing covering 3*a* or 3*b*. The central part 1 is more precisely formed by a bearing wall 4 made from cavernous concrete or similar material, covered, on its outwardly turned face, by a heat insulating layer 5, here formed by solid insulating panels such as expanded polystyrene.

In this constructional element, the framework 9 is partially buried in the bearing wall 4, its rectilinear rods being orientated in a vertical direction. The rectilinear rods 14*b* of the second row extend on a level with the inner face of bearing wall 4. Moreover, the framework 9 projects from the outer face 8 of wall 4 in order to serve as a support for insulating panels 5 which are wedged between the bearing wall 4 and the first row of rectilinear rods 14*a* while extending parallel to rods 14*a*. Thus, the central part 1 of the wall as a whole occupies the space of width L defined by the first and second rows of the rectilinear rods 14*a* and 14*b* of the framework 9.

In FIGS. 3 to 6, it will be further observed that the tops 15*a* of the sinusoidal wires carry the outer finishing covering 3*a* or 3*b*, whereas tops 15*b* carry the inner finishing covering 2*a* or 2*b*. Thus, the outer covering 3*a* or 3*b* defines with the central part 1 an air cavity in form of a blade 7 which corresponds to the space of width l mentioned above.

This air cavity 7 forms a thermal damper between the inside A and the outside B of the building.

According to a characteristic of the invention not shown in the figures, the air cavity 7 may be open at its base and communicate at the top, for example through a conventional ventilation aperture, with the external environment. Thus, a ventilated air cavity is provided which, in cooperation with the heat insulating layer 5, protects the concrete bearing wall 1 and the outer covering against thermal shocks resulting from considerable variations in the external temperature.

Figure 3:
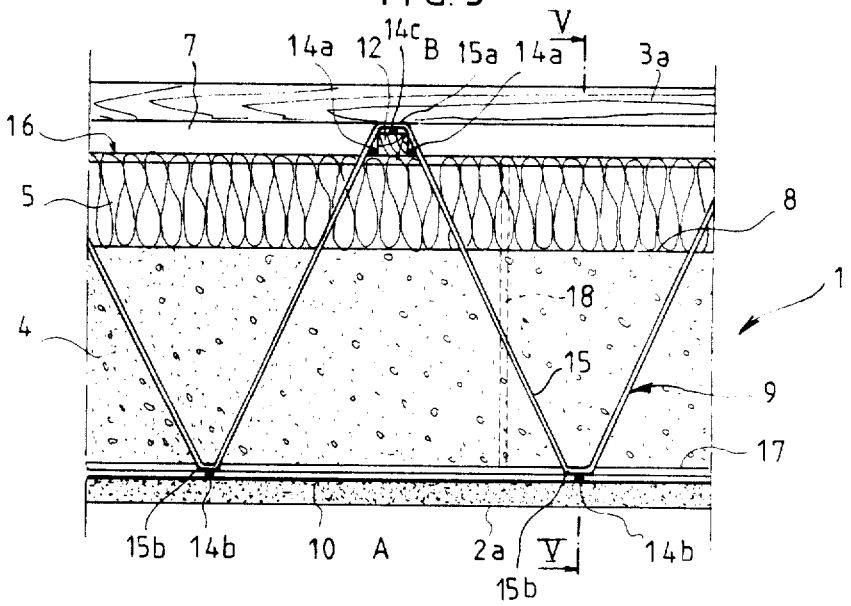
FIGS. 3 and 4 are cross-sectional views of the two embodiments of the constructional element formed from this framework.
Figure 4:
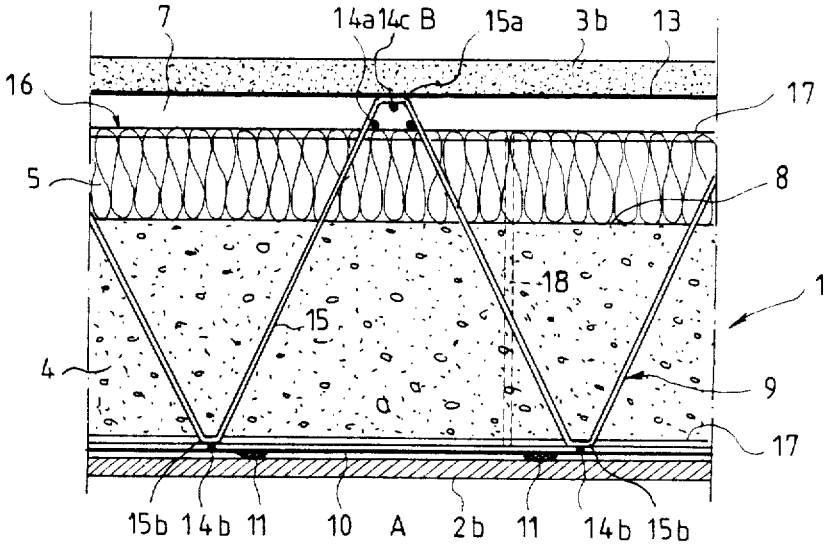
Figure 5:
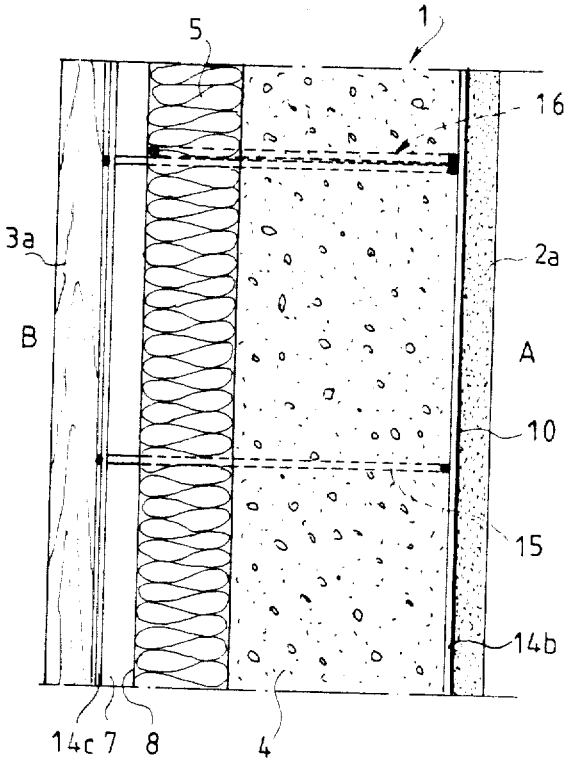
FIG. 5 is a sectional view along line V—V of FIG. 3.

To the rectilinear rods 14*b* of framework 9 which form the second row there is fixed, for example by clipping, a close mesh latticework 10 serving as a support for the inner finishing covering 2*a* or 2*b*, which may be a plaster coating 2*a* projected on to the latticework 10 (see FIG. 3) or a prefabricated compressed plaster panel 2*b*, fixed to the latticework 10 by means of adhesive plugs 11 (see FIG. 4).

In the embodiment of the constructional element of the invention shown in section in FIG. 4, a second close mesh latticework 13 is fixed to the rectilinear rods of framework 9, which form the third row of rods 14*c*, in order to serve as a support for the external finishing covering 3*b*, formed in general by a hydraulic coating projected on to the latticework 13, which for this purpose may support a cardboard or plastic material underface.

As a variation however and as shown in FIG. 3, a wooden batten 12 is locked inside each group of external superimposable tips 15*a* of the sinusoidal wires 15 of the framework, the outer covering 3*a* formed in this case by wooden boarding being nailed to these battens. Instead of wooden boarding, slate, aluminium or wooden tiles can be nailed to the battens 12.

It will be noted here that the above-mentioned latticework 10 and 13 may also be clipped to the tips 15*a* and 15*b* of sinusoidal wires 15 of framework 9 and, to offer a greater fixing area, these tops are flattened.

It can be further added that framework 9 is strengthened by a flat armature 16 resting on one of sinusoidal wires 15 and wedged between the two rows of rectilinear rods 14*a* and 14*b*. This armature is formed by two parallel bars 17 connected together by tie-rods 18.

Figure 6:
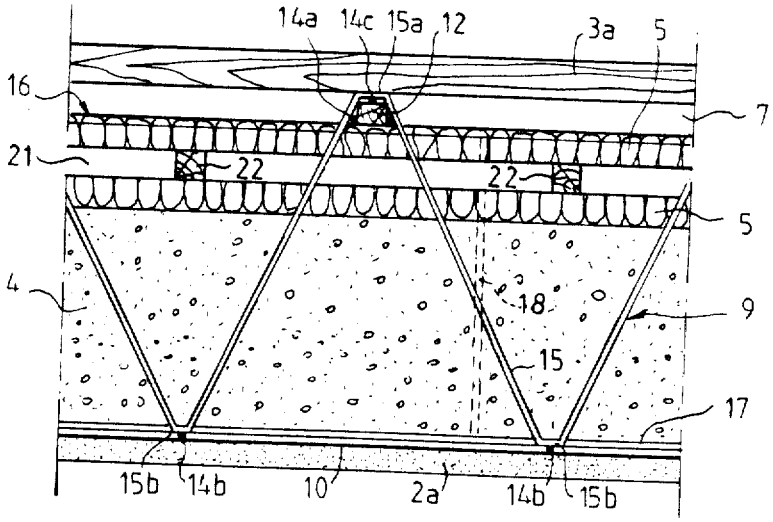
FIG. 6 is a cross-sectional view of a constructional element similar to that of FIG. 3 but having several air cavities.

FIG. 6 shows one embodiment of the constructional element of the invention including a heat insulating layer provided with an additional closed air cavity 21, the latter improving the insulating power of the constructional element.

More precisely, the additional air cavity 21 is defined by two adjacent insulating panels, held spaced apart from each other by wooden battens 22, locked therebetween and parallel to the rectilinear rods 14.

It is evident that in place of these battens two additional rows of rectilinear rods not shown could be provided on framework 9 for defining the air cavity 21.

Furthermore, it is of course possible to provide between the insulating panels several air cavities of this type so as to increase the heat insulating power of the constructional element a predetermined amount.

The constructional element which forms the subject of the present invention may be produced in different ways. However, in the case where it forms an outer wall of a dwelling, it is advantageous to construct it in accordance with the process described below.

Figure 7:
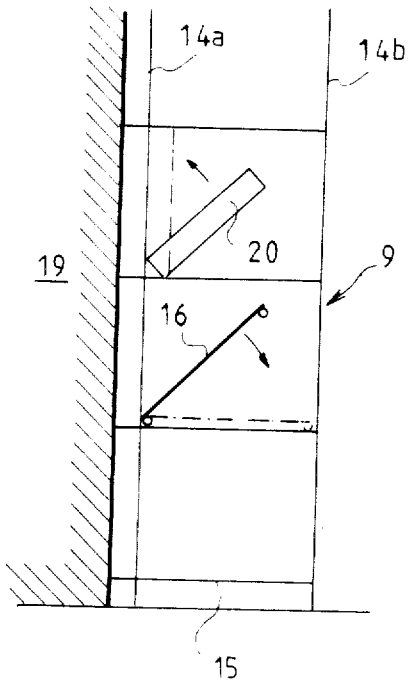
FIG. 7 shows schematically a phase in the manufacture of the constructional element of the invention.

First, in the workshop, framework 9 is secured to a fixed board 19, as shown in FIG. 7. Then, the armature 16 is introduced laterally into the framework, above a sinusoidal wire 15 thereof and it is positioned by clamping it between the rectilinear rods of first and second rows 14*a* and 14*b*, as shown with a dash-dot line in FIG. 7. From the other side of the framework heat insulating panels 20 are introduced which are set up by clamping them between the sinusoidal wires, as shown with a dash-dot line in FIG. 7. Then, the latticework 10 is fixed to the inside tips 15*b* of the sinusoidal wires of framework 9. After taking framework 9 from the board, battens 12 are fixed, as need be, to outer tips 15*a* or latticework 13. Then the inner and outer coverings 2*a*,2*b*, 3*a*,3*b* are placed in position. The next operation consists in taking the assembly thus formed to the work-site where it is fixed to a supporting wall, formed for example by the foundations of the building to be constructed, while orientating the rectilinear rods 14 of framework 9 in a vertical direction and disposing the third row of these rods on the outside of the wall. Finally, cavernous concrete or other concrete is poured in the space defined by the inner finishing covering 2*a* or 2*b* and the heat insulating panels, so as to form the bearing part 4 of the wall.

It should be noted that this constructional process allows the bearing part 4 of the wall to be cast, in an economical way, with lost shuttering and the major part of the wall to be produced rapidly in the workshop, protected against inclement weather.

Though the above description has been made with reference to an outer isothermic wall of a dwelling, it goes without saying that the framework of the invention allows any other isothermic walls of buildings to be constructed and particularly ceilings and inner dividing walls.

For the sake of completeness, it should be noted that the constructional element of the invention may be produced in the form of pre-fabricated panels.

By way of examples, the preferred dimensions of the different parts of the constructional element of the invention are given below.

Thickness of the insulating layer: 8 to 12 cm

Thickness of the bearing wall: 16 cm

Thickness of the air cavity: 3 cm

Distance between two sinusoidal wires: 25 l cm

Distance between the rectilinear rods of the third row: 34 cm

An external wall for a dwelling, having these dimensions, presents a thermal transmission coefficient of approximately 0.29. This coefficient, which is much less than those obtained in conventional isothermic walls, may be lowered to approximately 0.27 if several inner air cavities are provided.

I claim:

1. A central part assembly adapted to be used in an isothermic wall system of the type including a pair of finishing coverings, said central part assembly being disposed between said two finishing coverings, said central part assembly comprising:

a bearing wall;

a heat insulating layer disposed on one side of said bearing wall, and made of a solid insulating material;

a three-dimensional framework comprising a plurality of substantially parallel, rectilinear rods and a plurality of sinuous wires for supporting said rods, said sinuous wires being disposed in substantially parallel, spaced-apart planes and having a first plurality of edge tips defining a first longitudinal face of said framework supporting the first of said finishing coverings and a second plurality of edge tips defining a second longitudinal face of said framework supporting the second of said finishing coverings, said wires supporting a first plurality of said rods in a first plane spaced from said first plurality of edge tips at a distance less than the thickness of said bearing wall, and a second plurality of rods in a second plane substantially parallel to said first plane, said framework being partially disposed in said bearing wall so that said first plurality of rods and said first edge tips are spaced from said one side of said bearing wall;

wherein said heat insulating layer is disposed in said framework between said first plurality of rods and said one side of said bearing wall so that when said first finishing covering is supported by said first plurality of edge tips an air space is provided between said heat insulating layer and said first finishing covering.

2. The assembly according to claim 1, wherein said edge tips are substantially flat in the respective longitudinal face.

3. The assembly according to claim 1, wherein said second plurality of edge tips are disposed along the opposite face of said bearing wall so that said second finishing covering can be secured to said second plurality of edge tips.

4. The assembly according to claim 1, wherein said rectilinear rods of said framework are oriented in a substantially vertical direction and said first finishing covering forms the external covering of said wall.

5. The assembly according to claim 4, wherein said space between said heat insulating layer and said first finishing layer is an air cavity, said air cavity being open at its base and communicating at the top, through a ventilation aperture in said bearing wall, with the air on the opposite side of said wall.

6. The assembly according to claim 19, wherein said heat insulating layer includes a plurality of solid insulating panels vertically retained within said one side of said bearing wall, said wires of said framework, and said first plurality of rods.

7. The assembly according to claim 1, wherein at least one air cavity is provided in said heat insulating layer.

8. The assembly according to claim 7, wherein said air cavity is defined by two adjacent solid insulating panels, maintained spaced-apart from each other by battens clamped therebetween and disposed in a plane substantially parallel to said rectilinear rods.

9. The assembly according to claim 1, wherein said second plurality of rectilinear rods are fixed to said second plurality of edge tips.

10. The assembly according to claim 9, further including a closed mesh latticework secured to said second plurality of edge tips for supporting said second finishing covering.

11. The assembly according to claim 1, wherein said framework further comprises a third plurality of said rods disposed in a third plane parallel to the first and second planes and secured to said first plurality of edge tips.

12. The assembly according to claim 11, further including a close mesh latticework fixed to said third plurality of rods for supporting said first finishing covering.

13. The assembly according to claim 1, wherein said first plurality of edge tips and said first plurality of rods define a plurality of spaces for supporting a plurality of battens in spaced-apart relation so that said first finishing covering can be attached to said battens.

14. The assembly according to claim 1, further including at least one flat armature resting on one of said sinuous wires and clamped between said first and second plurality of rectilinear rods.

15. The assembly according to claim 14, wherein said armature is formed by two parallel bars disposed in a plane transverse to said first and second planes and connected together with tie-rods.

* * * * *

UNITED STATES PATENT AND TRADEMARK OFFICE

CERTIFICATE OF CORRECTION

PATENT NO. : 4,530,191

DATED : July 23, 1985

INVENTOR(S) : Arsene G. Boisbluche

It is certified that error appears in the above-identified patent and that said Letters Patent is hereby corrected as shown below:

Claim 6, column 7, line 30, "19" should be -- 4 --.

Signed and Sealed this

*Eighth* Day of *October 1985*

[SEAL]

*Attest:*

DONALD J. QUIGG

*Attesting Officer*

*Commissioner of Patents and Trademarks—Designate*